US009822609B2

(12) United States Patent
Wright et al.

(10) Patent No.: US 9,822,609 B2
(45) Date of Patent: Nov. 21, 2017

(54) WELL TOOLS OPERABLE VIA THERMAL EXPANSION RESULTING FROM REACTIVE MATERIALS

(71) Applicant: HALLIBURTON ENERGY SERVICES, INC., Houston, TX (US)

(72) Inventors: Adam D. Wright, Cypress, TX (US); Michael L. Fripp, Carrollton, TX (US); Donald G. Kyle, Plano, TX (US); Cyrus A. Irani, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/452,588

(22) Filed: Aug. 6, 2014

(65) Prior Publication Data

US 2014/0345851 A1 Nov. 27, 2014

Related U.S. Application Data

(62) Division of application No. 12/688,058, filed on Jan. 15, 2010, now Pat. No. 8,839,871.

(51) Int. Cl.
*E21B 36/00* (2006.01)
*E21B 23/04* (2006.01)
(Continued)

(52) U.S. Cl.
CPC ..... *E21B 36/008* (2013.01); *E21B 23/04* (2013.01); *E21B 47/011* (2013.01); *E21B 47/06* (2013.01); *E21B 49/081* (2013.01)

(58) Field of Classification Search
CPC ..... E21B 36/008; E21B 49/081; E21B 23/04; E21B 47/06
See application file for complete search history.

(56) References Cited

U.S. PATENT DOCUMENTS 2,076,308 A * 4/1937 Wells ..... 166/300
2,189,937 A 2/1940 Broyles
(Continued)

FOREIGN PATENT DOCUMENTS

WO 0220942 A1 3/2002
WO 2004099564 A2 11/2004

OTHER PUBLICATIONS

Search Report dated Jun. 23, 2011 for International Patent Application Serial No. PCT/US10/61047, 5 pages.
(Continued)

*Primary Examiner* — Kenneth L Thompson
(74) *Attorney, Agent, or Firm* — Chamberlain Hrdlicka

(57) ABSTRACT

Methods of actuating a well tool can include releasing chemical energy from at least one portion of a reactive material, thermally expanding a substance in response to the released chemical energy, and applying pressure to a piston as a result of thermally expanding the substance, thereby actuating the well tool, with these steps being repeated for each of multiple actuations of the well tool. A well tool actuator can include a substance contained in a chamber, one or more portions of a reactive material from which chemical energy is released, and a piston to which pressure is applied due to thermal expansion of the substance in response to each release of chemical energy. A well tool actuator which can be actuated multiple times may include multiple portions of a gas generating reactive material, and a piston to which pressure is applied due to generation of the gas.

20 Claims, 5 Drawing Sheets

(51) Int. Cl.

| | |
|---|---|
| ***E21B 49/08*** | (2006.01) |
| ***E21B 47/06*** | (2012.01) |
| ***E21B 47/01*** | (2012.01) |

(56) References Cited

U.S. PATENT DOCUMENTS 2,308,004 A 1/1943 Hart
2,330,265 A 9/1943 Burt
2,373,006 A 4/1945 Baker
2,381,929 A 8/1945 Schlumberger
2,618,343 A 11/1952 Conrad
2,637,402 A 5/1953 Baker et al.
2,640,547 A 6/1953 Baker et al.
2,695,064 A 11/1954 Ragan et al.
2,701,614 A * 2/1955 Ragan ..... E21B 23/065 166/120
2,961,045 A 11/1960 Stogner et al.
2,974,727 A 3/1961 Goodwin
3,029,873 A 4/1962 Hanes
3,055,430 A 9/1962 Campbell
3,122,728 A 2/1964 Linberg
3,160,209 A 12/1964 Bonner
RE25,846 E 8/1965 Campbell
3,217,804 A 11/1965 Peter
3,233,674 A * 2/1966 Leutwyler ..... E21B 23/04 166/116
3,264,994 A * 8/1966 Leutwyler ..... E21B 47/122 102/206
3,266,575 A 8/1966 Owen
3,398,803 A 8/1968 Leutwyler et al.
3,556,211 A 1/1971 Bohn et al.
4,081,031 A * 3/1978 Mohaupt ..... F42D 1/00 102/301
4,085,590 A 4/1978 Powell et al.
4,282,931 A 8/1981 Golben
4,352,397 A 10/1982 Christopher
4,377,209 A 3/1983 Golben
4,385,494 A 5/1983 Golben
4,402,187 A 9/1983 Golben
4,598,769 A 7/1986 Robertson
4,884,953 A 12/1989 Golben
5,024,270 A 6/1991 Bostick
5,052,489 A * 10/1991 Carisella ..... F42D 1/04 166/297
5,074,940 A 12/1991 Ochi et al.
5,101,907 A 4/1992 Schultz et al.
5,197,758 A 3/1993 Lund et al.
5,211,224 A 5/1993 Bouldin
5,238,070 A 8/1993 Schultz et al.
5,316,087 A * 5/1994 Manke et al. ..... 166/381
5,396,951 A * 3/1995 Ross ..... E21B 23/065 166/63
5,452,763 A 9/1995 Owen
5,476,018 A 12/1995 Nakanishi et al.
5,485,884 A 1/1996 Hanley et al.
5,531,845 A 7/1996 Flanigan et al.
5,573,307 A 11/1996 Wilkinson et al.
5,662,166 A 9/1997 Shammai
5,673,556 A 10/1997 Goldben et al.
5,687,791 A 11/1997 Beck et al.
5,700,974 A 12/1997 Taylor
5,725,699 A 3/1998 Hinshaw et al.
6,055,213 A * 4/2000 Rubbo ..... E21B 41/00 175/40
6,128,904 A 10/2000 Rosso et al.
6,186,226 B1 2/2001 Robertson
6,378,611 B1 4/2002 Helderle
6,536,524 B1 3/2003 Snider
6,561,479 B1 5/2003 Eldridge
6,568,470 B2 5/2003 Goodson, Jr. et al.
6,598,679 B2 7/2003 Robertson
6,695,061 B2 * 2/2004 Fripp ..... E21B 23/04 166/187
6,705,425 B2 3/2004 West
6,776,255 B2 8/2004 West et al.
6,854,522 B2 * 2/2005 Brezinski ..... E21B 33/12 166/187
6,925,937 B2 8/2005 Robertson
6,971,449 B1 12/2005 Robertson
6,973,993 B2 12/2005 West et al.
7,083,009 B2 8/2006 Paluch et al.
7,152,657 B2 12/2006 Bosma et al.
7,152,679 B2 12/2006 Simpson
7,191,672 B2 3/2007 Ringgenberg et al.
7,197,923 B1 4/2007 Wright et al.
7,237,616 B2 * 7/2007 Patel ..... E21B 23/00 166/381
7,367,394 B2 5/2008 Villareal et al.
7,431,335 B2 10/2008 Khandhadia et al.
7,472,589 B2 1/2009 Irani et al.
7,591,319 B2 * 9/2009 Xu ..... E21B 23/065 166/319
7,640,965 B2 1/2010 Bosma et al.
7,669,661 B2 * 3/2010 Johnson ..... E21B 23/04 166/373
7,987,914 B2 8/2011 Benton
8,196,515 B2 6/2012 Streibich et al.
8,459,377 B2 * 6/2013 Moyes ..... E21B 4/02 166/300
8,474,533 B2 7/2013 Miller
2004/0149418 A1 8/2004 Bosma et al.
2004/0227509 A1 11/2004 Ucan
2005/0115614 A1 6/2005 Einhaus
2005/0115708 A1 6/2005 Jabusch
2006/0124310 A1 6/2006 Lopez De Cardenas et al.
2006/0144590 A1 7/2006 Lopez De Cardenas et al.
2007/0039508 A1 2/2007 Saito et al.
2007/0089911 A1 4/2007 Moyes
2007/0101808 A1 5/2007 Irani et al.
2007/0137826 A1 6/2007 Bosma et al.
2007/0284118 A1 * 12/2007 Benton ..... 166/386
2008/0236840 A1 10/2008 Nguy
2009/0183879 A1 * 7/2009 Cox ..... 166/302
2009/0241658 A1 10/2009 Irani et al.
2009/0301233 A1 12/2009 Irani et al.
2009/0308588 A1 12/2009 Howell et al.
2009/0314497 A1 * 12/2009 Johnson ..... 166/381
2010/0084060 A1 4/2010 Hinshaw et al.
2010/0201352 A1 8/2010 Englert
2011/0132223 A1 6/2011 Streibich et al.
2011/0174504 A1 7/2011 Wright et al.
2011/0240311 A1 10/2011 Robison et al.
2011/0284240 A1 11/2011 Chen et al.

OTHER PUBLICATIONS

Written Opinion dated Jun. 23, 2011 for International Patent Application Serial No. PCT/US10/61047, 4 pages.

International Search Report with Written Opinion dated Nov. 30, 2011 for PCT Patent Application No. PCT/US11/036686, 10 pages.

International Search Report and Written Opinion dated Mar. 11, 2013 for PCT Application No. PCT/US2012/050762, 14 pages.

* cited by examiner

WELL TOOLS OPERABLE VIA THERMAL EXPANSION RESULTING FROM REACTIVE MATERIALS

CROSS-REFERENCE TO RELATED APPLICATION

This application is a division of prior application Ser. No. 12/688,058, filed on 15 Jan. 2010. The entire disclosure of this prior application is incorporated herein by this reference.

BACKGROUND

This disclosure relates generally to equipment utilized and operations performed in conjunction with a subterranean well and, in an example described below, more particularly provides well tools operable via thermal expansion resulting from reactive materials.

Power for actuating downhole well tools can be supplied from a variety of sources, such as batteries, compressed gas, etc. However, even though advancements have been made in supplying power for actuation of well tools, the various conventional means each have drawbacks (e.g., temperature limitations, operational safety, etc.). Therefore, it will be appreciated that improvements are needed in the art of actuating downhole well tools.

SUMMARY

In the disclosure below, well tool actuators and associated methods are provided which bring improvements to the art. One example is described below in which a substance is thermally expanded to actuate a well tool. Another example is described below in which the well tool can be actuated multiple times.

In one aspect, a method of actuating a well tool in a well is provided by the disclosure. The method can include:

a) releasing chemical energy from at least one portion of a reactive material;

b) thermally expanding a substance in response to the released chemical energy; and c) applying pressure to a piston as a result of thermally expanding the substance, thereby actuating the well tool.

In another aspect, the method can include, for each of multiple actuations of the well tool, performing the set of steps a)-c) listed above.

In yet another aspect, a well tool actuator is disclosed which can include a substance contained in a chamber, one or more portions of a reactive material from which chemical energy is released, and a piston to which pressure is applied due to thermal expansion of the substance in response to release of chemical energy from the reactive material.

In a further aspect, a method of actuating a well tool multiple times in a well can include, for each of multiple actuations of the well tool while the well tool remains positioned in the well, performing the following set of steps: a) generating gas from at least one portion of a reactive material; and b) applying pressure to a piston as a result of generating gas from the portion of the reactive material, thereby actuating the well tool.

In a still further aspect, a well tool actuator is disclosed which includes multiple portions of a reactive material which generates gas; and a piston to which pressure is applied due to generation of gas by the reactive material.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
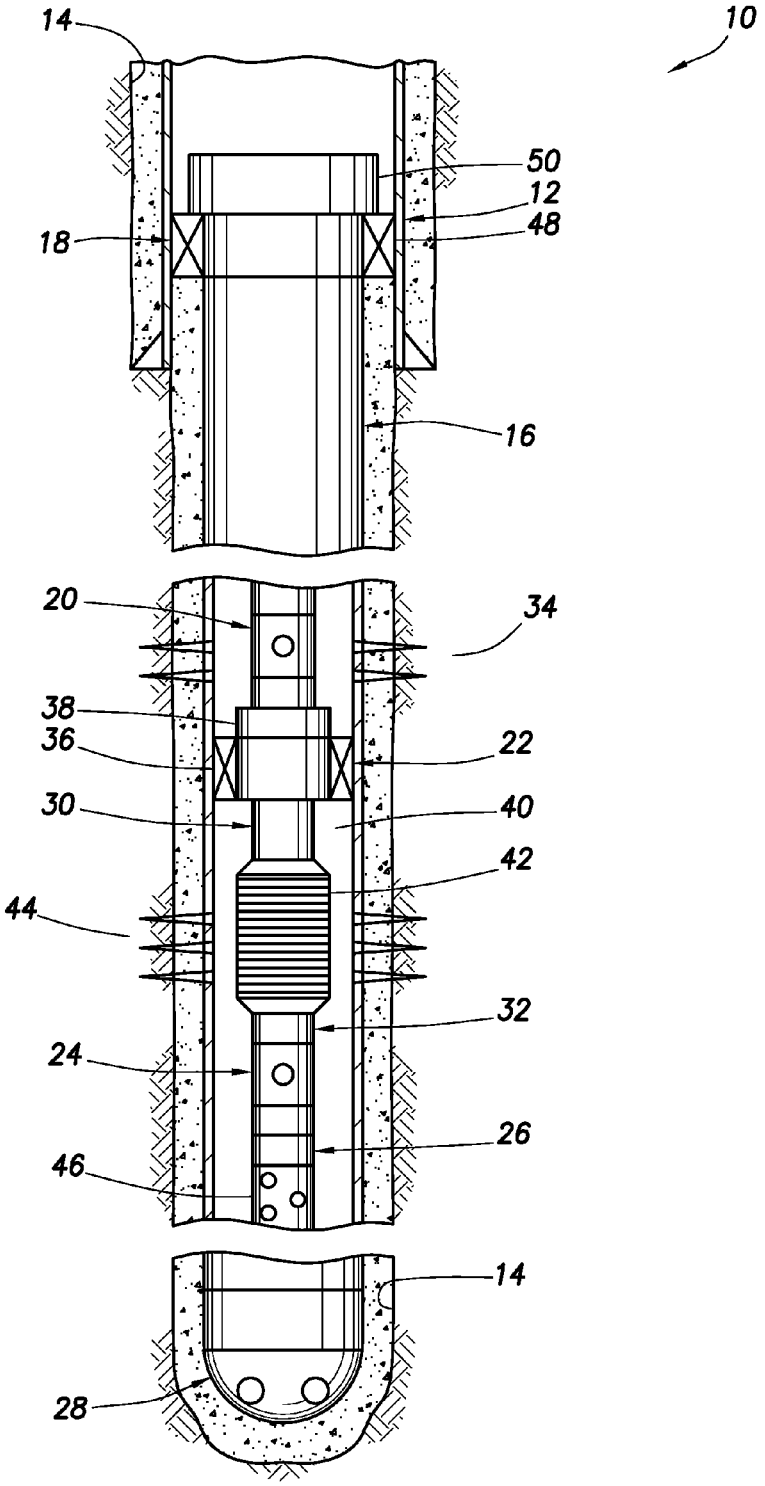
FIG. 1 is a schematic partially cross-sectional view of a well system which can embody principles of the present disclosure.

Representatively illustrated in FIG. 1 are a well system 10 and associated methods which embody principles of the present disclosure. The well system 10 includes a casing string or other type of tubular string 12 installed in a wellbore 14. A liner string or other type of tubular string 16 has been secured to the tubular string 12 by use of a liner hanger or other type of well tool 18.

The well tool 18 includes an anchoring device 48 and an actuator 50. The actuator 50 sets the anchoring device 48, so that the tubular string 16 is secured to the tubular string 12. The well tool 18 may also include a sealing device (such as the sealing device 36 described below) for sealing between the tubular strings 12, 16 if desired.

The well tool 18 is one example of a wide variety of well tools which may incorporate principles of this disclosure. Other types of well tools which may incorporate the principles of this disclosure are described below. However, it should be clearly understood that the principles of this disclosure are not limited to use only with the well tools described herein, and these well tools may be used in other well systems and in other methods without departing from the principles of this disclosure.

In addition to the well tool 18, the well system 10 includes well tools 20, 22, 24, 26, 28 and 30. The well tool 20 includes a flow control device (for example, a valve or choke, etc.) for controlling flow between an interior and exterior of a tubular string 32. As depicted in FIG. 1, the well tool 20 also controls flow between the interior of the tubular string 32 and a formation or zone 34 intersected by an extension of the wellbore 14.

The well tool 22 is of the type known to those skilled in the art as a packer. The well tool 22 includes a sealing device 36 and an actuator 38 for setting the sealing device, so that it prevents flow through an annulus 40 formed between the tubular strings 16, 32. The well tool 22 may also include an anchoring device (such as the anchoring device 48 described above) for securing the tubular string 32 to the tubular string 16, if desired.

The well tool 24 includes a flow control device (for example, a valve or choke, etc.) for controlling flow between the annulus 40 and the interior of the tubular string 32. As depicted in FIG. 1, the well tool 24 is positioned with a well screen assembly 42 in the wellbore 14. Preferably, the flow control device of the well tool 24 allows the tubular string 32 to fill as it is lowered into the well (so that the flow does not have to pass through the screen assembly 42, which might damage or clog the screen) and then, after installation, the flow control device closes (so that the flow of fluid from a zone 44 intersected by the wellbore 14 to the interior of the tubular string is filtered by the screen assembly).

The well tool 26 is of the type known to those skilled in the art as a firing head. The well tool 26 is used to detonate perforating guns 46. Preferably, the well tool 26 includes features which prevent the perforating guns 46 from being detonated until they have been safely installed in the well.

The well tool 28 is of the type known to those skilled in the art as a cementing shoe or cementing valve. Preferably, the well tool 28 allows the tubular string 16 to fill with fluid as it is being installed in the well, and then, after installation but prior to cementing the tubular string in the well, the well tool permits only one-way flow (for example, in the manner of a check valve).

The well tool 30 is of the type known to those skilled in the art as a formation isolation valve or fluid loss control valve. Preferably, the well tool 30 prevents downwardly directed flow (as viewed in FIG. 1) through an interior flow passage of the tubular string 32, for example, to prevent loss of well fluid to the zone 44 during completion operations. Eventually, the well tool 30 is actuated to permit downwardly directed flow (for example, to allow unrestricted access or flow therethrough).

Although only the actuators 38, 50 have been described above for actuating the well tools 18, 22, it should be understood that any of the other well tools 20, 24, 26, 28, 30 may also include actuators. However, it is not necessary for any of the well tools 18, 20, 22, 24, 26, 28, 30 to include a separate actuator in keeping with the principles of this disclosure.

It should also be understood that any type of well tool can be actuated using the principles of this disclosure. For example, in addition to the well tools 18, 20, 22, 24, 26, 28, 30 described above, various types of production valves, formation fluid samplers, packers, plugs, liner hangers, sand control devices, safety valves, etc., can be actuated. The principles of this disclosure can be utilized in drilling tools, wireline tools, slickline tools, tools that are dropped in the well, tools that are pumped in the well, or any other type of well tool.

Figure 2:
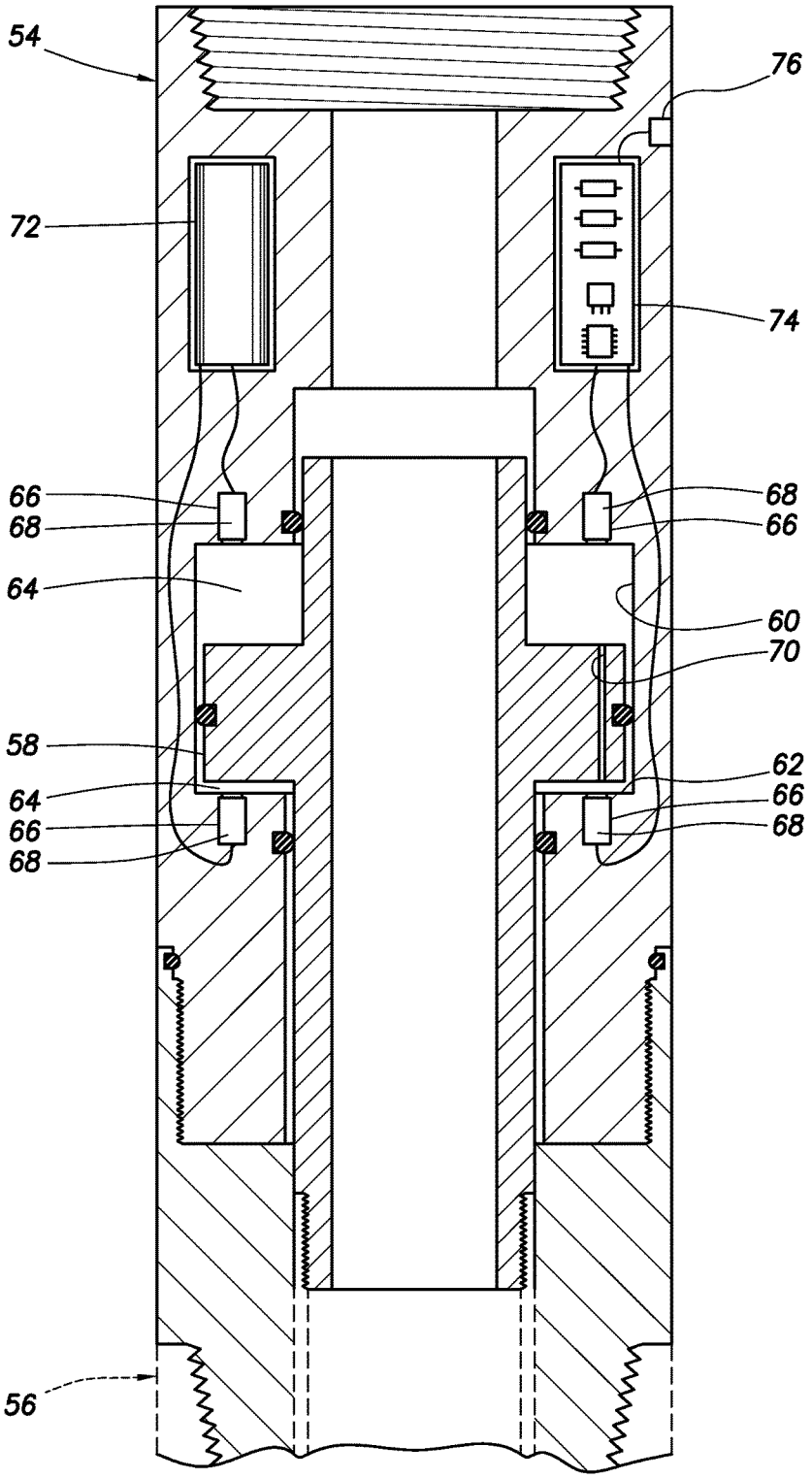
FIG. 2 is an enlarged scale schematic cross-sectional view of a well tool actuator which may be used in the system of FIG. 1.

Referring additionally now to FIG. 2, a well tool actuator 54 which embodies principles of this disclosure is representatively illustrated. The actuator 54 is used to actuate a well tool 56. The well tool 56 may be any of the well tools 18, 20, 22, 24, 26, 28, 30 described above, or any other type of well tool. The actuator 54 may be used for any of the actuators 38, 50 in the system 10, or the actuator 54 may be used in any other well system.

As depicted in FIG. 2, the actuator 54 includes an annular piston 58 which separates two annular chambers 60, 62. A thermally expandable substance 64 is disposed in each chamber 60, 62. The substance 64 could comprise a gas (such as, argon or nitrogen, etc.), a liquid (such as, water or alcohol, etc.) and/or a solid.

Portions 66 of a reactive material 68 are used to thermally expand the substance 64 and thereby apply a differential pressure across the piston 58. The piston 58 may in some embodiments displace as a result of the biasing force due to the differential pressure across the piston to thereby actuate the well tool 56, or the biasing force may be used to actuate the well tool without requiring much (if any) displacement of the piston.

A latching mechanism (not shown) could restrict movement of the piston 58 until activation of the reactive material 68. For example, there could be a shear pin initially preventing displacement of the piston 58, so that the differential pressure across the piston has to increase to a predetermined level for the shear pin to shear and release the piston for displacement. Alternatively, or in addition, an elastomeric element (such as an o-ring on the piston 58) may be used to provide friction to thereby hold the piston in position prior to activation of the reactive material 68.

In the example of FIG. 2, chemical energy may be released from one of the portions 66 of the reactive material 68 on a lower side of the piston 58 to cause thermal expansion of the substance 64 in the lower chamber 62. This thermal expansion of the substance 64 in the lower chamber 62 will cause an increased pressure to be applied to a lower side of the piston 58, thereby biasing the piston upward and actuating the well tool 56 in one manner (e.g., closing a valve, setting an anchoring device, etc.). The piston 58 may displace upward to actuate the well tool 56 in response to the biasing force generated by the thermally expanded substance 64.

Chemical energy may then be released from one of the portions 66 of the reactive material 68 on an upper side of the piston 58 to cause thermal expansion of the substance 64 in the upper chamber 60. This thermal expansion of the substance 64 in the upper chamber 60 will cause an increased pressure to be applied to an upper side of the piston 58, thereby biasing the piston downward and actuating the well tool 56 in another manner (e.g., opening a valve, unsetting an anchoring device, etc.). The piston 58 may displace downward to actuate the well tool 56 in response to the biasing force generated by the thermally expanded substance 64.

In one beneficial feature of the actuator 54 as depicted in FIG. 2, this method of actuating the well tool 56 may be repeated as desired. For this purpose, multiple portions 66 of the reactive material 68 are available for causing thermal expansion of the substance 64 both above and below the piston 58.

Although only two portions 66 are visible in FIG. 2 positioned above and below the piston 58, any number of portions may be used, as desired. The portions 66 may be radially distributed in the ends of the chambers 60, 62 (as depicted in FIG. 2), the portions could be positioned on only one side of the piston 58 (with passages being used to connect some of the portions to the opposite side of the piston), the portions could be stacked longitudinally, etc. Thus, it will be appreciated that the portions 66 of the reactive material 68 could be located in any positions relative to the piston 58 and chambers 60, 62 in keeping with the principles of this disclosure.

As depicted in FIG. 2, multiple portions 66 of the reactive material 68 are used for expanding the substance 64 in the chamber 60, and a similar multiple portions 66 are used for expanding the substance 64 in the chamber 62. However, in other examples, each portion 66 of reactive material 68 could be used to expand a substance in a respective separate chamber, so that the portions do not "share" a chamber.

A passage 70 is provided for gradually equalizing pressure across the piston 58 after the substance 64 has been expanded in either of the chambers 60, 62. The passage 70 may be in the form of an orifice or other type of restrictive passage which permits sufficient pressure differential to be created across the piston 58 for actuation of the well tool 56 when the substance 64 is expanded in one of the chambers 60, 62. After the well tool 56 has been actuated, pressure in the chambers 60, 62 is equalized via the passage 70, thereby providing for subsequent actuation of the well tool, if desired.

The reactive material 68 is preferably a material which is thermally stable and non-explosive. A suitable material is known as thermite (typically provided as a mixture of powdered aluminum and iron oxide or copper oxide, along with an optional binder).

When heated to ignition temperature, an exothermic reaction takes place in which the aluminum is oxidized and elemental iron or copper results. Ignition heat may be provided in the actuator 54 by electrical current (e.g., supplied by batteries 72) flowing through resistance elements (not visible in FIG. 2) in the portions 66. However, note that any source of ignition heat (e.g., detonators, fuses, etc.) may be used in keeping with the principles of this disclosure.

The reactive material 68 preferably produces substantial heat as chemical energy is released from the material. This heat is used to thermally expand the substance 64 and thereby apply pressure to the piston 58 to actuate the well tool 56. Heating of the substance 64 may cause a phase change in the substance (e.g., liquid to gas, solid to liquid, or solid to gas), in which case increased thermal expansion can result.

Release of chemical energy from the reactive material 68 may also result in increased pressure itself (e.g., due to release of products of combustion, generation of gas, etc.). Alternatively, activation of the reactive material 68 may produce pressure primarily as a result of gas generation, rather than production of heat.

Note that thermite is only one example of a suitable reactive material which may be used for the reactive material 68 in the actuator 54. Other types of reactive materials may be used in keeping with the principles of this disclosure. Any type of reactive material from which sufficient chemical energy can be released may be used for the reactive material 68. Preferably, the reactive material 68 comprises no (or only a minimal amount of) explosive. For example, a propellant could be used for the reactive material 68.

In various examples, the reactive material 68 may comprise an explosive, a propellant and/or a flammable solid, etc. The reactive material 68 may function exclusively or primarily as a gas generator, or as a heat generator.

Electronic circuitry 74 may be used to control the selection and timing of ignition of the individual portions 66. Operation of the circuitry 74 may be telemetry controlled (e.g., by electromagnetic, acoustic, pressure pulse, pipe manipulation, any wired or wireless telemetry method, etc.). For example, a sensor 76 could be connected to the circuitry 74 and used to detect pressure, vibration, electromagnetic radiation, stress, strain, or any other signal transmission parameter. Upon detection of an appropriate telemetry signal, the circuitry 74 would ignite an appropriate one or more of the portions 66 to thereby actuate the well tool 56.

Note that the reactive material 68 is not necessarily electrically activated. For example, the reactive material 68 could be mechanically activated (e.g., by impacting a percussive detonator), or heated to activation temperature by compression (e.g., upon rupturing a rupture disk at a preselected pressure, a piston could compress the reactive material 68 in a chamber).

Figure 3:
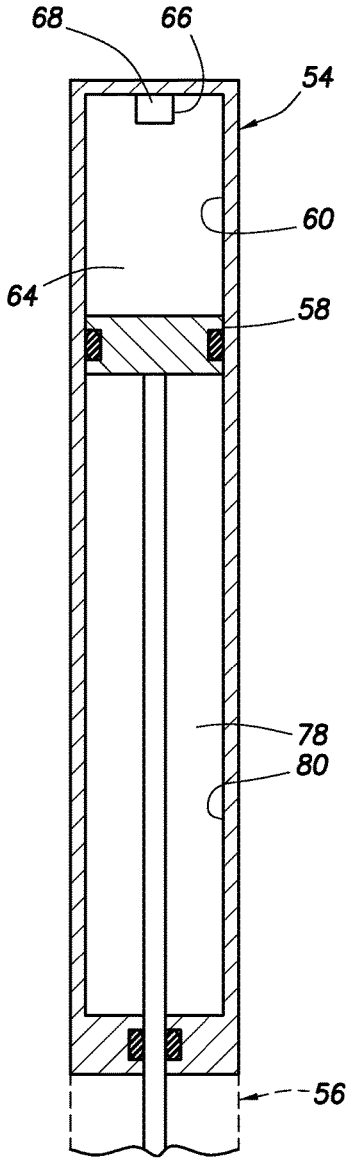
FIGS. 3-5 are schematic cross-sectional views of another configuration of the well tool actuator, the actuator being depicted in various stages of actuation.
Figure 4:
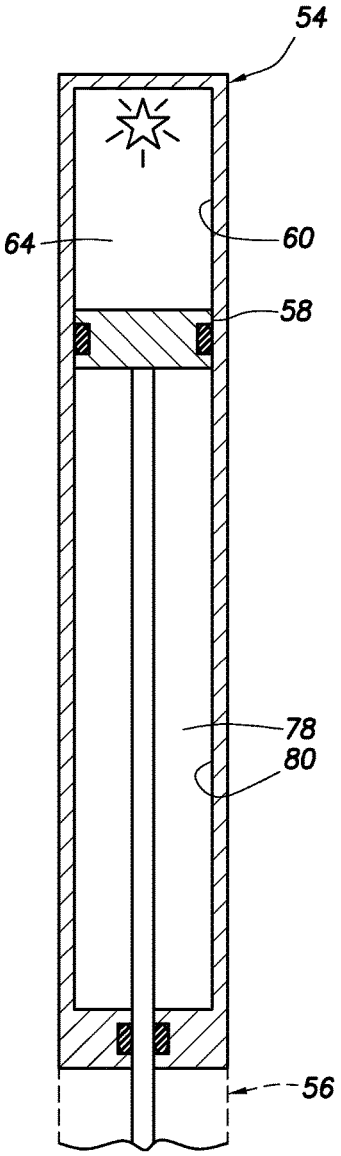
Figure 5:
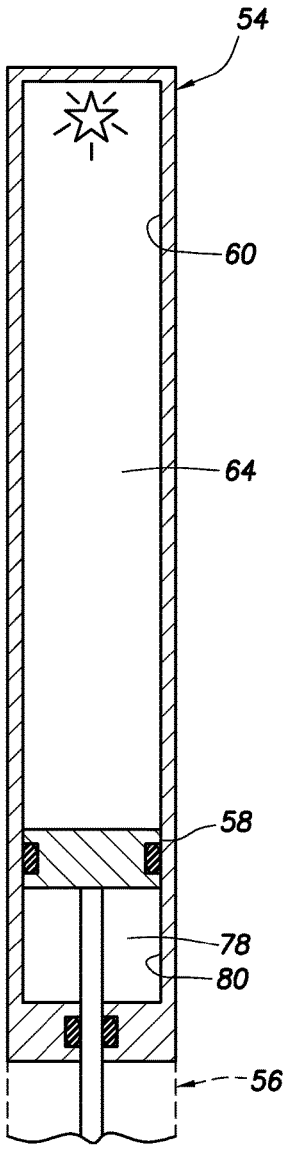

Referring additionally now to FIGS. 3-5, another configuration of the actuator 54 is representatively and schematically illustrated. As depicted in FIGS. 3-5, only a single portion 66 of the reactive material 68 is used, but multiple portions could be used, as described more fully below.

In the example of FIGS. 3-5, the substance 64 comprises water, which is prevented from boiling at downhole temperatures by a biasing device 78 which pressurizes the water. The biasing device 78 in this example comprises a gas spring (such as a chamber 80 having pressurized nitrogen gas therein), but other types of biasing devices (such as a coil or wave spring, etc.) may be used, if desired. In this example, the substance 64 is compressed by the biasing device 78 prior to conveying the well tool into the well.

In other examples, the substance 64 (such as water) could be prevented from boiling prematurely by preventing displacement of the piston 58. Shear pins, a release mechanism, high friction seals, etc. may be used to prevent or restrict displacement of the piston 58. Of course, if the anticipated downhole temperature does not exceed the boiling (or other phase change) temperature of the substance 64, then it is not necessary to provide any means to prevent boiling (or other phase change) of the substance.

In FIG. 3, the actuator 54 is depicted at a surface condition, in which the nitrogen gas is pressurized to a relatively low pressure, sufficient to prevent the water from boiling at downhole temperatures, but not sufficiently high to create a safety hazard at the surface. For example, at surface the nitrogen gas could be pressurized to approximately 10 bar (~150 psi).

In FIG. 4, the actuator 54 is depicted at a downhole condition, in which chemical energy has been released from the reactive material 68, thereby thermally expanding the substance 64 and applying a pressure differential across the piston 58. In this example, the piston 58 does not displace appreciably (or at all) when the well tool 56 is actuated. However, preliminary calculations suggest that substantial force can be generated to actuate the well tool 56, for example, resulting from up to approximately 7000 bar (~105,000 psi) pressure differential being created across the piston 58.

In FIG. 5, the actuator 54 is depicted at a downhole condition, in which chemical energy has been released from the reactive material 68, thereby thermally expanding the substance 64 and applying a pressure differential across the piston 58, as in the example of FIG. 4. However, in the example of FIG. 5, the piston 58 displaces in response to the thermal expansion of the substance 64, in order to actuate the well tool 56. Depending on the amount of displacement of the piston 58, approximately 750-1900 bar (~10-25,000 psi) pressure differential may remain across the piston 58 at the end of its displacement.

Multiple actuations of the well tool 56 may be accomplished by allowing the substance 64 to cool, thereby relieving (or at least reducing) the thermal expansion of the substance 64 and, thus, the pressure differential across the piston 58. When the substance 64 is sufficiently cooled, another portion 66 of the reactive material 68 may be ignited to again cause thermal expansion of the substance 64. For this purpose, multiple portions 66 of the reactive material 68 may be connected to, within, or otherwise communicable with, the chamber 60.

In the example of FIG. 5, the piston 58 will displace downward each time the substance 64 is thermally expanded, and the piston will displace upward each time the substance is allowed to cool. The batteries 72, electronic circuitry 74 and sensor 76 may be used as described above to selectively and individually control ignition of each of multiple portions 66 of the reactive material 68.

In some applications, it may be desirable to incorporate a latching mechanism or friction producer to prevent displacement of the piston 58 when the substance 64 cools. For example, in a formation fluid sampler, a one-way latch mechanism would be useful to maintain pressure on a sampled formation fluid as it is retrieved to the surface.

The substance 64 and portion 66 shape can be configured to control the manner in which chemical energy is released from the substance. For example, a grain size of the substance 64 can be increased or reduced, the composition can be altered, etc., to control the amount of heat generated and the rate at which the heat is generated. As another example, the portion 66 can be more distributed (e.g., elongated, shaped as a long rod, etc.) to slow the rate of heat generation, or the portion can be compact (e.g., shaped as a sphere or cube, etc.) to increase the rate of heat generation.

Figure 6:
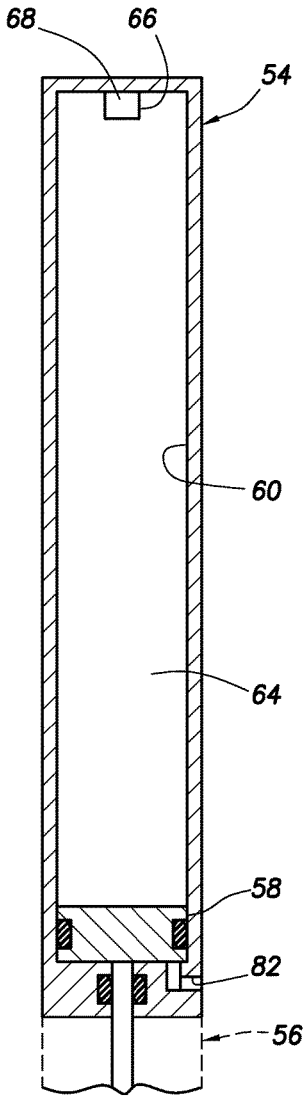
FIGS. 6-8 are schematic cross-sectional views of another configuration of the well tool actuator, the actuator being depicted in various stages of actuation.
Figure 7:
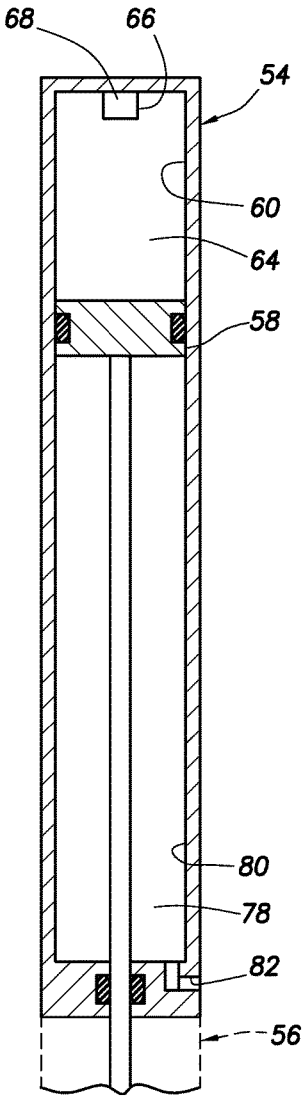
Figure 8:
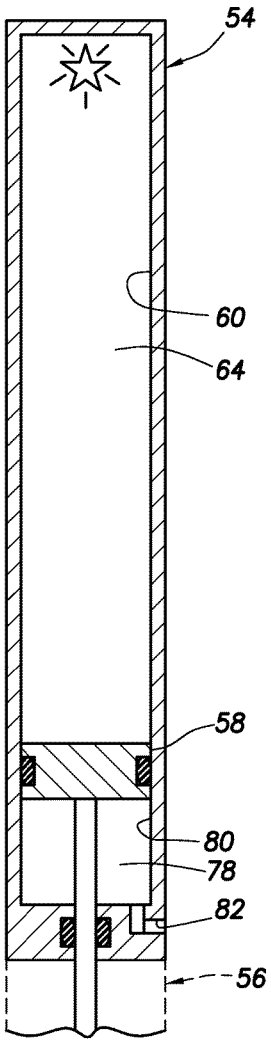

Referring additionally now to FIGS. 6-8, another configuration of the actuator 54 is representatively and schematically illustrated. The configuration of FIGS. 6-8 is similar in many respects to the configuration of FIGS. 3-5. However, a significant difference in the configuration of FIGS. 6-8 is that the biasing device 78 utilizes hydrostatic pressure in the well to compress or pressurize the substance 64.

In the example of FIGS. 6-8, the substance 64 comprises a gas, such as nitrogen. However, other thermally expandable substances may be used in the configuration of FIGS. 6-8, if desired.

In FIG. 6, the actuator 54 is depicted in a surface condition, prior to being conveyed into the well. Preferably the substance 64 is pressurized in the chamber 60. For example, if nitrogen gas is used for the substance 64, the gas can conveniently be pressurized to approximately 200 bar (~3,000 psi) at the surface using conventional equipment.

In FIG. 7, the actuator 54 is depicted in a downhole condition, i.e., after the actuator has been conveyed into the well. Hydrostatic pressure enters the chamber 80 via a port 82 and, depending on the particular pressures, the piston areas exposed to the pressures, etc., the piston 58 displaces upward relative to its FIG. 6 configuration. This further compresses the substance 64 in the chamber 60. If, instead of nitrogen gas, the substance 64 comprises water or another substance which would otherwise undergo a phase change at downhole temperatures, this compression of the substance by the hydrostatic pressure in the chamber 80 can prevent the phase change occurring prematurely or otherwise undesirably.

Hydrostatic pressure in the chamber 80 is only one type of biasing device which may be used to compress the substance 64 in the chamber 60. The substance 64 could also, or alternatively, be mechanically compressed (e.g., using a coiled or wave spring to bias the piston 58 upward) or otherwise compressed (e.g., using a compressed fluid spring in the chamber 80) in keeping with the principles of this disclosure. If a biasing device such as a spring is used, the substance 64 can be compressed prior to conveying the well tool into the well.

An initial actuation or arming of the well tool 56 may occur when the piston 58 displaces upward from the FIG. 6 configuration to the FIG. 7 configuration. Alternatively, the well tool 56 may only actuate when the piston 58 displaces downward.

In FIG. 8, the piston 58 has displaced downward from the FIG. 7 configuration, due to release of chemical energy from the reactive material 68. This energy heats the substance 64 and causes it to thermally expand, thereby increasing pressure in the chamber 60 and biasing the piston 58 downward.

As with the configuration of FIGS. 3-5, multiple actuations of the well tool 56 may be accomplished with the configuration of FIGS. 6-8 by allowing the substance 64 to cool, thereby relieving (or at least reducing) the thermal expansion of the substance 64. The hydrostatic pressure in the chamber 80 can then bias the piston 58 to displace upward (e.g., to or near its FIG. 7 position). When the substance 64 is sufficiently cooled, another portion 66 of the reactive material 68 may be ignited to again cause thermal expansion of the substance 64. For this purpose, multiple portions 66 of the reactive material 68 may be connected to, within, or otherwise communicable with, the chamber 60.

Figure 9:
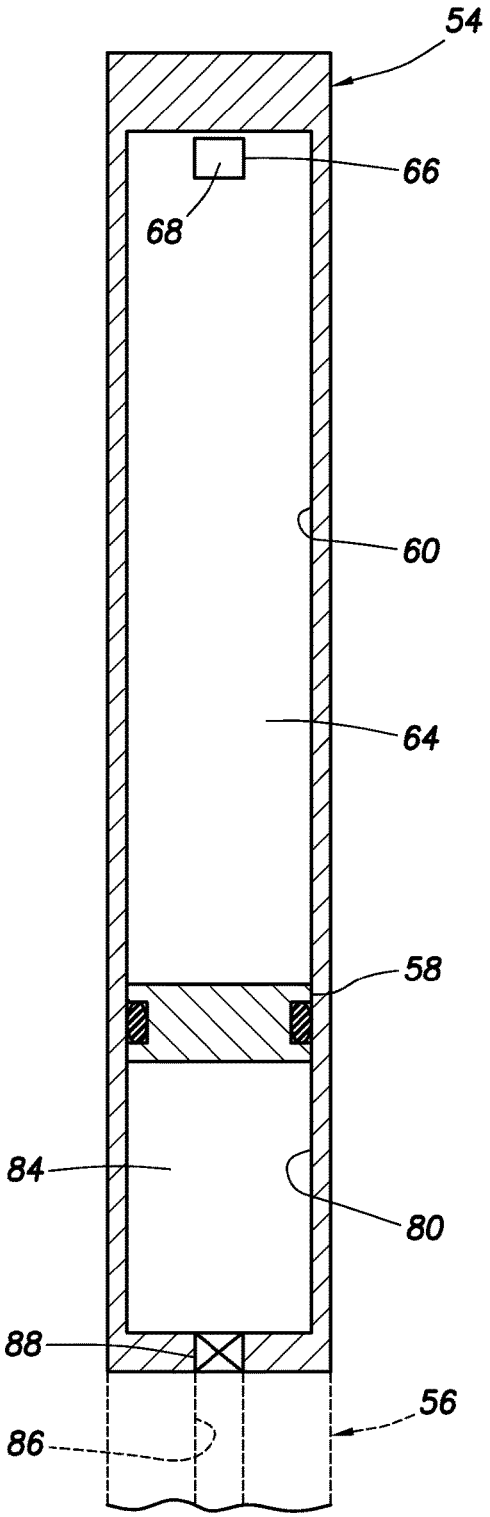
FIGS. 9 & 10 are schematic cross-sectional views of another configuration of the well tool actuator, the actuator being depicted prior to and after actuation.
Figure 10:
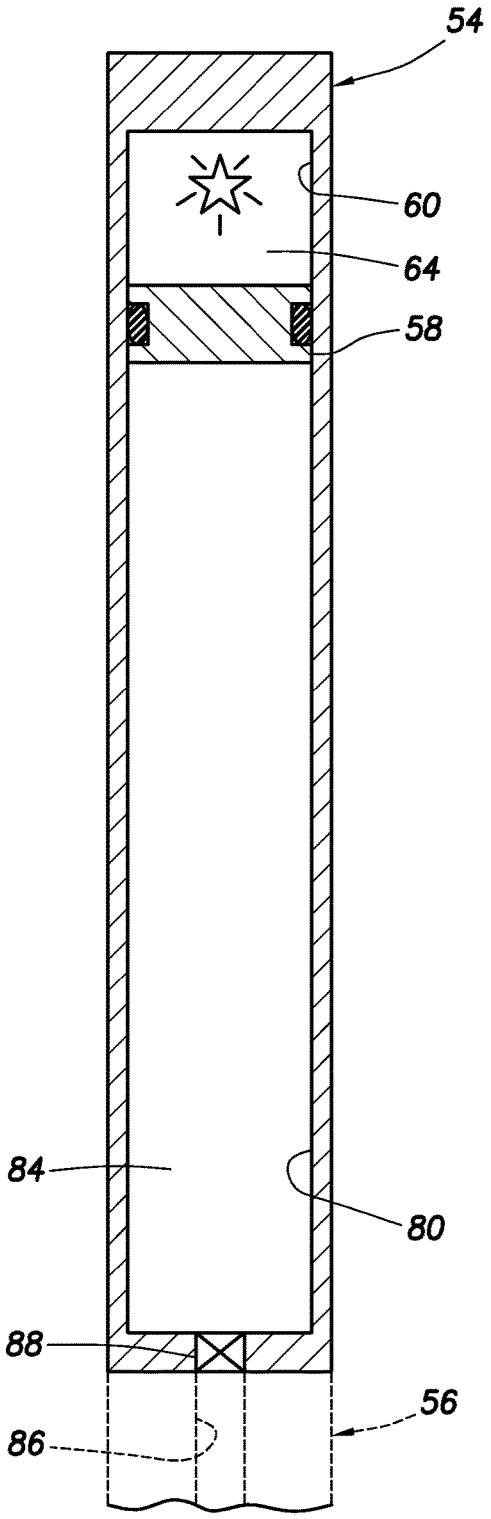

Referring additionally now to FIGS. 9 and 10, another configuration of the actuator 54 is representatively and schematically illustrated. The configuration of FIGS. 9 and 10 is similar in many respects to the configurations of FIGS. 3-8. However, one significant difference is that, in the configuration of FIGS. 9 and 10, thermal expansion of the substance 64 is used to compress a sample of formation fluid 84 in the chamber 80 (e.g., to maintain the formation fluid pressurized as it is retrieved to the surface, and to thereby prevent a phase change from occurring in the formation fluid as it is retrieved to the surface).

The well tool 56 in this example comprises a formation fluid sampler of the type well known to those skilled in the art. However, in the example of FIGS. 9 and 10, the formation fluid sample 84 is received into the chamber 80 via a passage 86 and a valve 88, with the valve being closed after the formation fluid sample is received into the chamber. Note that the valve 88 is another type of well tool which can be actuated using the principles of this disclosure.

In FIG. 9, the actuator 54 is depicted as the formation fluid sample 84 is being received into the chamber 80. The valve 88 is open, and the formation fluid sample 84 flows via the passage 86 and valve into the chamber 80, thereby displacing the piston 58 upward and compressing the substance 64 in the chamber 60. Preferably, a metering device (not shown) is used to limit a displacement speed of the piston 58, so that the sample 84 received in the chamber 80 remains representative of its state when received from the formation.

The substance 64 may or may not be pressurized prior to the formation fluid sample 84 being received into the chamber 80. For example, if the substance 64 comprises a gas (such as nitrogen gas), the substance could conveniently be pressurized to approximately 200 bar (~3,000 psi) at the surface using conventional equipment, prior to conveying the actuator 54 and well tool 56 into the well.

In FIG. 10, the formation fluid sample 84 has been received into the chamber 80, and the valve 88 has been closed. Chemical energy has then been released from the reactive material 68, thereby heating and thermally expanding the substance 64. The piston 58 transmits pressure between the chambers 60, 80. In this manner, the formation fluid sample 84 will remain pressurized as the actuator 54 and well tool 56 are retrieved to the surface.

In situations where the substance 64 could cool and undesirably reduce pressure applied to the sample 84 as the well tool is retrieved to the surface, a latching mechanism (not shown) may be used to maintain pressure in the chamber 80 as the well tool is conveyed out of the well. Alternatively, or in addition, a check valve (not shown) and a compressible fluid can be used to maintain pressure on the sample 84 when the substance 64 cools.

Multiple portions 66 of the reactive material 68 could be provided in the example of FIGS. 9 & 10 so that, as the well tool is retrieved from the well, additional portions of the reactive material could be activated as needed to maintain a desired pressure on the sample 84. A pressure sensor (not shown) could be used to monitor pressure on the sample 84 and, when the pressure decreases to a predetermined level as the substance 64 cools, an additional portion 66 of the reactive material 68 could be activated.

In this embodiment, the reactive material 68 preferably functions primarily as a gas generator, rather than as a heat generator. In that case, the substance 64 may not be used, since pressure in the chamber 60 can be generated by production of gas from the reactive material. The substance 64 is also not required in any of the other embodiments described above, if the reactive material 68 can generate sufficient pressure due to gas production when the reactive material is activated.

In each of the examples described above in which multiple portions 66 of reactive material 68 may be used, note that the portions can be isolated from each other (for example, to prevent activation of one portion from causing activation or preventing activation of another portion). A phenolic material is one example of a suitable material which could serve to isolate the multiple portions 66 from each other.

Furthermore, each of the portions 66 of reactive material 68 described above could be encapsulated (for example, to prevent contamination or oxidation of the reactive material by the working fluid).

It may now be fully appreciated that the above disclosure provides several advancements to the art of actuating downhole well tools. In examples described above, well tools are actuated in a convenient, effective and efficient manner, without necessarily requiring use of explosives or highly pressurized containers at the surface. In some of the examples described above, the actuators can be remotely controlled via telemetry, and the actuators can be operated multiple times downhole.

The above disclosure provides a method of actuating a well tool 56 in a well. The method can include: a) releasing chemical energy from at least one portion 66 of a reactive material 68; b) thermally expanding a substance 64 in response to the released chemical energy; and c) applying pressure to a piston 58 as a result of thermally expanding the substance 64, thereby actuating the well tool 56.

The method can also include the above listed set of steps multiple times while the well tool 56 is positioned downhole.

The method can include allowing the substance 64 to cool between each successive set of steps.

The method can include reducing pressure applied to the piston 58 as a result of allowing the substance 64 to cool.

The method can include displacing the piston 58 as a result of allowing the substance 64 to cool.

The method can include displacing the piston 58 in one direction as a result of applying pressure to the piston 58; and displacing the piston 58 in an opposite direction as a result of allowing the substance 64 to cool after thermally expanding the substance.

The method can include compressing the substance 64 due to hydrostatic pressure while conveying the well tool 56 into the well.

The method can include compressing a formation fluid sample 84 as a result of applying pressure to the piston 58.

The thermally expanding step can include changing a phase of the substance 64.

The step of releasing chemical energy can include oxidizing an aluminum component of the reactive material 68.

Also provided by the above disclosure is a method of actuating a well tool 56 multiple times in a well. The method can include, for each of multiple actuations of the well tool 56, performing the following set of steps:

a) releasing chemical energy from at least one portion 66 of a reactive material 68;

b) thermally expanding a substance 64 in response to the released chemical energy; and c) applying pressure to a piston 58 as a result of thermally expanding the substance 64, thereby actuating the well tool 56.

The above disclosure also describes a well tool actuator 54 which can include a substance 64 contained in a chamber 60, one or more portions 66 of a reactive material 68 from which chemical energy is released, and a piston 58 to which pressure is applied due to thermal expansion of the substance 64 in response to release of chemical energy from the reactive material 68.

Hydrostatic pressure in a well may compress the substance 64 in the chamber 60.

The piston 58 may displace in response to the applied pressure.

Chemical energy may be released from multiple portions 66 individually.

Chemical energy released from the reactive material 68 in a first one of the portions 66 may cause thermal expansion of the substance 64 in the chamber 60, and chemical energy released from the reactive material 68 in a second one of the portions 66 may cause thermal expansion of the substance 64 in another chamber 62. The piston 58 may displace in one direction in response to thermal expansion of the substance 64 in the first chamber 60, and the piston 58 may displace in an opposite direction in response to thermal expansion of the substance 64 in the second chamber 62.

The actuator 54 may include a passage 70 which equalizes pressure across the piston 58.

The substance 64 may comprise a solid, liquid and/or a gas.

The reactive material 68 may comprise aluminum and at least one of iron oxide and copper oxide.

The above disclosure also provides a method of actuating a well tool 56 multiple times in a well, the method comprising: for each of multiple actuations of the well tool 56 while the well tool 56 remains positioned in the well, performing the following set of steps: a) generating gas from at least one portion 66 of a reactive material 68; and b) applying pressure to a piston 58 as a result of generating gas from the portion 66 of the reactive material 68, thereby actuating the well tool 56.

The method may include allowing the gas to cool between each successive set of steps. The pressure applied to the piston may be reduced as a result of allowing the gas to cool. The piston may displace as a result of allowing the gas to cool.

The piston may displace in one direction as a result of each step of applying pressure to the piston, and the piston may displace in an opposite direction as a result of allowing the gas to cool.

Also described in the above disclosure is a well tool actuator 54 which includes multiple portions 66 of a reactive material 68 which generates gas, and a piston 58 to which pressure is applied due to generation of gas by the reactive material 68.

The piston 58 may displace in response to the applied pressure. The gas may be generated from the multiple portions 66 individually and/or sequentially.

The piston 58 may displace in one direction in response to generation of gas from a first one of the portions 66 of reactive material 68, and the piston may displace in an opposite direction in response to generation of gas from a second one of the portions 66 of reactive material 68.

The well tool actuator 54 can include a passage 70 which equalizes pressure across the piston 58.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," "upward," "downward," etc., are used for convenience in referring to the accompanying drawings. The above-described upward and downward displacements of the piston 58 are merely for illustrative purposes, and the piston 58 may displace in any direction(s) in keeping with the principles of this disclosure.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. An actuator for actuating a tool in a well, comprising:
- a non-explosive reactive material configured to release chemical energy when activated, wherein the non-explosive reactive material comprises a mixture of two reagents and is connected to and communicable with a first chamber;
- a substance located in the first chamber and thermally expandable by the release of the chemical energy from the non-explosive reactive material; and
- a piston in pressure communication with the well and to which pressure is applied due to the thermal expansion of the substance in the first chamber.

2. The actuator of claim 1, wherein the substance is compressible by hydrostatic pressure in the well.

3. The actuator of claim 1, wherein the piston is displaceable in response to the applied pressure.

4. The actuator of claim 1, wherein chemical energy is releasable from one or more portions of the non-explosive reactive material individually.

5. The actuator of claim 1, wherein the chemical energy released from the non-explosive reactive material in a first portion of the non-explosive reactive material causes thermal expansion of the substance in the first chamber, and chemical energy released from the non-explosive reactive material in a second portion of the non-explosive reactive material causes thermal expansion of the substance in a second chamber.

6. The actuator of claim 5, wherein the piston is displaceable in a first direction in response to thermal expansion of the substance in the first chamber, and the piston is displaceable in a second direction opposite to the first direction in response to thermal expansion of the substance in the second chamber.

7. The actuator of claim 5, further comprising a passage configured to equalize pressure across the piston.

8. The actuator of claim 1, wherein the non-explosive reactive material comprises a thermite mixture.

9. The actuator of claim 8, wherein the thermite mixture comprises powdered aluminum and at least one of iron oxide, copper oxide, or a combination thereof.

10. The actuator of claim 8, wherein the substance comprises at least one of nitrogen gas or water.

11. An actuator for actuating a tool in a well, comprising:
- a piston in pressure communication with the well;
- a thermally expandable substance located on a side of the piston in a chamber; and
- a non-explosive reactive material configured to release chemical energy when activated and to thermally expand the substance to apply pressure to the side of the piston, wherein the non-explosive reactive material comprises a mixture of two reagents and is connected to and communicable with the chamber.

12. The actuator of claim 11, wherein the piston is displaceable in response to the applied pressure.

13. The actuator of claim 11, wherein gas is generated from multiple portions of the non-explosive reactive material individually.

14. The actuator of claim 11, wherein gas is generated from multiple portions of the non-explosive reactive material sequentially.

15. The actuator of claim 11, wherein the piston is displaceable in a first direction in response to generation of gas from a first portion of the non-explosive reactive material, and the piston is displaceable in a second direction opposite the first direction in response to generation of gas from a second portion of the non-explosive reactive material.

16. The actuator of claim 11, further comprising a passage configured to equalize pressure across the piston.

17. The actuator of claim 11, wherein the non-explosive reactive material comprises a thermite mixture.

18. The actuator of claim 17, wherein the thermite mixture comprises powdered aluminum and at least one of iron oxide, copper oxide, or a combination thereof.

19. The actuator of claim 17, wherein the substance comprises at least one of nitrogen gas or water.

20. An actuator for actuating a tool in a well, comprising:
- a non-explosive reactive material configured to release chemical energy when activated;
- a substance located in a first chamber and thermally expandable by the release of the chemical energy from the non-explosive reactive material;
- a piston in pressure communication with the well and to which pressure is applied due to the thermal expansion of the substance in the first chamber;
- wherein the chemical energy released from the non-explosive reactive material in a first portion of the non-explosive reactive material causes thermal expansion of the substance in the first chamber; and
- wherein chemical energy released from the non-explosive reactive material in a second portion of the non-explosive reactive material causes thermal expansion of the substance in a second chamber.

* * * * *